US012264576B2

(12) United States Patent
Al-Huwaider et al.

(10) Patent No.: US 12,264,576 B2
(45) Date of Patent: Apr. 1, 2025

(54) COOLING WELLBORE LOGGING TOOLS

(71) Applicant: Saudi Arabian Oil Company, Dhahran (SA)

(72) Inventors: Mustafa A. Al-Huwaider, Dhahran (SA); Noureddine Benlakhdar, Dhahran (SA); Shouxiang Mark Ma, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/168,153

(22) Filed: Feb. 13, 2023

(65) Prior Publication Data

US 2024/0271520 A1 Aug. 15, 2024

(51) Int. Cl.
*E21B 47/017* (2012.01)
*E21B 47/12* (2012.01)
*E21B 47/26* (2012.01)

(52) U.S. Cl.
CPC ..... *E21B 47/0175* (2020.05); *E21B 47/138* (2020.05); *E21B 47/26* (2020.05)

(58) Field of Classification Search
CPC ..... E21B 47/0175; E21B 47/017
See application file for complete search history.

(56) References Cited

U.S. PATENT DOCUMENTS

| | | | | |
|---|---|---|---|---|
| 3,882,937 | A * | 5/1975 | Robinson | E21B 43/38 166/57 |
| 4,375,157 | A | 3/1983 | Boesen | |
| 6,629,570 | B1 * | 10/2003 | Head | E21B 4/02 175/26 |
| 6,877,332 | B2 | 4/2005 | DiFoggio | |
| 8,453,738 | B2 | 6/2013 | Martinez | |
| 9,256,045 | B2 | 2/2016 | Singh | |
| 9,617,828 | B2 | 4/2017 | Marzouk et al. | |
| 10,012,054 | B2 | 7/2018 | Ciglenec et al. | |
| 10,774,617 | B2 | 9/2020 | Zhan | |
| 11,371,338 | B2 | 6/2022 | Alexeyenko | |
| 11,441,416 | B2 | 9/2022 | Adebiyi et al. | |
| 2006/0162931 | A1 | 7/2006 | Mayes | |
| 2008/0277162 | A1 | 11/2008 | DiFoggio | |
| 2011/0079391 | A1 | 4/2011 | Bedouet et al. | |
| 2016/0076339 | A1 * | 3/2016 | Martin | E21B 47/017 166/57 |

FOREIGN PATENT DOCUMENTS

| | | |
|---|---|---|
| CA | 2773632 | 10/2013 |

OTHER PUBLICATIONS

International Search Report and Written Opinion in International Appln No. PCT/US2024/014424, dated May 8, 2024, 11 pages.

(Continued)

*Primary Examiner* — Kristyn A Hall
(74) *Attorney, Agent, or Firm* — Fish & Richardson P.C.

(57) ABSTRACT

An assembly and a method for cooling a downhole logging tool. The assembly includes a coiled tubing assembly having a downhole logging tool and a coiled tubing pipe. The coiled tubing pipe is coupled to the downhole logging tool. The coiled tubing pipe includes a cooling fluid tube. The cooling fluid tube conducts a cooling fluid to the downhole logging tool.

10 Claims, 9 Drawing Sheets

(56) References Cited

OTHER PUBLICATIONS

Bi et al., "Improvements on High Temperature Lithium Oxyhalide Primary Battery for Downhole Tools Power Applications," presented at the Abu Dhabi International Petroleum Exhibition & Conference, Abu Dhabi, UAE, Nov. 16, 2021, 9 pages.
Khastoo et al., "Thermal Wellbore Failure Detection Case Studies: A High Temperature Multi-Finger Caliper Surveillance Approach," presented at the SPE Thermal Well Integrity and Design Symposium, Banff, Alberta, Canada, Nov. 29-30, 2021, 12 pages.
Tezuka et al., "The High Temperature (400° C.) Memory Type Fluid-Density Logging Tool The 4th Parameter For Geothermal Well Evaluation," presented at the SPWLA 43rd Annual Logging Symposium, Oiso, Japan, Jun. 2-5, 2002, 8 pages.

* cited by examiner

COOLING WELLBORE LOGGING TOOLS

TECHNICAL FIELD

This disclosure relates to controlling a temperature of wellbore logging tools.

BACKGROUND OF THE DISCLOSURE

In oil and gas production operations, formation fluids (hydrocarbon oil and gas, along with water), flow from formations of the Earth into a wellbore drilled from a surface of the Earth to the formations beneath the surface of the Earth. The formations have a formation temperature and a formation pressure. Logging tools can be positioned in the wellbore to sense and measure properties of the formations, fluids, and gases. The logging tools can have a high temperature operating limit. When positioned in the wellbore, the logging tools can be exposed to the formation temperature and formation pressure. In some cases, when positioned in the wellbore, the formation temperature can reach or exceed the high temperature operating limit of the logging tools, which can result in logging tool functional failure and even physical or electrical damage, which can be a major challenge for evaluation of geo-thermal formations.

SUMMARY

Implementations of the present disclosure include an assembly and a method for cooling a downhole logging tool with a coiled tubing assembly. The coiled tubing assembly can place the downhole logging tool in the wellbore to sense conditions of the wellbore and the geological formations surrounding the wellbore. The coiled tubing assembly can include a coiled tubing pipe coupled to the downhole logging tool. The present disclosure relates to cooling the downhole logging tool.

In one aspect, a coiled tubing assembly includes a downhole logging tool and a coiled tubing pipe. The coiled tubing pipe is coupled to the downhole logging tool. The coiled tubing pipe includes a cooling fluid tube. The cooling fluid tube conducts a cooling fluid to the downhole logging tool.

In some implementations, the coiled tubing pipe includes a first end coupled to a coiled tubing reel and a second end coupled to the downhole logging tool. The coiled tubing assembly has a cooling fluid source coupled to the first end of the coiled tubing pipe. The cooling fluid source supplies the cooling fluid to the cooling fluid tube.

In some implementations, the downhole logging tool includes at least one sensor or electrical circuit having a high temperature operating upper limit. In some cases, the high temperature operating upper limit of the downhole logging tool is 350° F. In some cases, a flow of the cooling fluid through the cooling fluid tube past the downhole logging tool conducts heat from the downhole logging tool to the cooling fluid. In some cases, a flow of the cooling fluid through the cooling fluid tube past the downhole logging tool maintains a temperature of the sensor or the electrical circuit below the high temperature operating upper limit.

In some implementations, the coiled tubing pipe includes a tool power and communication cable extending from a controller to the downhole logging tool. The controller performs operations including operating the coiled tubing assembly and the downhole logging tool. The tool power and communication cable is positioned in and extends through the coiled tubing pipe.

In some implementations, the downhole logging tool includes a cooling fluid vent extending from an internal void of the coiled tubing pipe to an outer shell of the downhole logging tool and coupled to a downhole end of the cooling fluid tube. In some cases, the cooling fluid vent conducts the cooling fluid from the downhole logging tool to a space outside the downhole logging tool.

In some implementations, the coiled tubing pipe includes a heat exchanged fluid tube positioned in and extending through the coiled tubing pipe. The heat exchanged fluid tube can be coupled to a downhole end of the cooling fluid tube. The heat exchanged fluid tube receives the cooling fluid from the cooling fluid tube and conducts the cooling fluid in an uphole direction through the coiled tubing pipe. In some cases, the heat exchanged fluid tube conducts the cooling fluid to a surface of the Earth in the uphole direction.

In another aspect, a coiled tubing pipe positions a downhole logging tool in a wellbore. The coiled tubing pipe includes a cooling fluid tube. The cooling fluid tube conducts a cooling fluid to the downhole logging tool.

In some implementations, a central axis of the cooling fluid tube is parallel to a central axis of the coiled tubing pipe.

In some implementations, a flow of the cooling fluid through the cooling fluid tube past the downhole logging tool conducts heat from the downhole logging tool to the cooling fluid.

In some implementations, a flow of the cooling fluid through the cooling fluid tube past the downhole logging tool maintains a temperature of the downhole logging tool below a high temperature operating upper limit of the downhole logging tool.

In some implementations, the coiled tubing pipe has an outer pipe defining an internal void. The cooling fluid tube is positioned in and extends through the internal void of the outer pipe. In some cases, the coiled tubing pipe has a tool power and communication cable to transmit electrical power to the downhole logging tool, transmit control signals to the downhole logging tool, and transmit status signals from the downhole logging tool. The tool power and communication cable is positioned in and extends through the internal void of the outer pipe.

In some implementations, the coiled tubing pipe includes a heat insulating material positioned in the internal void of the outer pipe.

In some implementations, the coiled tubing pipe includes a heat exchanged fluid tube positioned in and extending through the internal void of the outer pipe. The heat exchanged fluid tube is coupled to a downhole end of the cooling fluid tube. The heat exchanged fluid tube receives the cooling fluid from the cooling fluid tube and conducts the cooling fluid in an uphole direction through the coiled tubing pipe. In some cases, the heat exchanged fluid tube conducts the cooling fluid to a surface of the Earth in the uphole direction.

Implementations of the present disclosure can realize one or more of the following advantages. Extra high temperature formations, such as the extra deep oil and gas reservoirs or geothermal formations, can be evaluated with existing downhole logging tools. These systems and methods to cool the downhole logging tool can allow the downhole logging tool to operate at its designed temperature, that is, within its designed operating temperature range (between a low temperature design limit and a high temperature design limit). For example, cooling the downhole logging tool when the downhole logging tool is generating heat (from the operation of electronics and sensors), the heat can be removed from the downhole logging tool to maintain the downhole logging tool at its designed working temperature. For example, responsive to the downhole logging tool being placed in near a high temperature/high pressure geologic reservoir, the downhole logging tool can receive heat from the high temperature/high pressure geologic reservoir, heating the downhole logging tool to a temperature at or above the high temperature design limit. Removing the heat from the high temperature/high pressure geologic reservoir to the designed operating temperature range can allow the downhole logging tool to operate at its designed temperature.

These systems and methods to cool the downhole logging tool can improve detection of geologic reservoir properties. For example, cooling the downhole logging tool to maintain the downhole logging tool within a desired operating range can increase sensitivity of a sensor of the downhole logging tool, which can, in turn, improve detection of geologic reservoir properties.

These systems and methods to cool the downhole logging tool can decrease wellbore logging operation total time. For example, costly and time-intensive cooling operations such as wellbore reconditioning by pumping cold water or liquid nitrogen into the wellbore to reduce a wellbore temperature can be avoided. In some cases, such reconditioning operations can kill the well (i.e., stop formation fluid flow) or damage a wellbore surface or the geologic reservoir. In other cases, the reconditioning operations can damage wellbore components, such as tubulars or casings. Cooling the downhole logging tool with coiled tubing assembly of the present disclosure can avoid such damage and decrease wellbore logging operation time.

These systems and methods to cool the downhole logging tool according to implementations of the present disclosure can improve wellbore integrity. For example, the wellbore reconditioning by pumping cold water or liquid nitrogen can damage the geologic reservoir, subterranean formations, wellbore tubulars, wellbore casings, or other completion equipment. By cooling the downhole logging tool with the coiled tubing assembly having a coiled tubing pipe with a cooling fluid tube, such wellbore reconditioning operations can be avoided.

These systems and methods to cool the downhole logging tool can increase downhole logging tool lifetime. For example, by maintaining the temperature of the downhole logging tool within the designed operating temperature range, degradation of electrical components and materials due to heat can be decreased. Decreasing the degradation of electrical components and materials can increase the downhole logging tool lifetime.

Other aspects and advantages of this disclosure will be apparent from the following description made with reference to the accompanying drawings and the claims.

DETAILED DESCRIPTION

An oil and gas well has a wellbore extending from a surface of the Earth to subterranean formations in the Earth. The subterranean formations contain liquid and gaseous phases of various fluids including water, oils, and gases. The wellbore conducts the fluids from the subterranean formations to the surface. The subterranean formations have a formation temperature and a formation pressure. Some formations can be characterized as high temperature and high pressure formations. Downhole logging tools can be positioned in the wellbore to sense and measure properties of the subterranean formations, fluids, and gases. When positioned in the wellbore, the logging tools can be exposed to the formation temperature and formation pressure. The downhole logging tools have a high temperature operating limit, which, when exceeded, can cause the tool to malfunction or even become damaged.

The present disclosure relates to an assembly and a method for cooling a downhole logging tool with a coiled tubing assembly. The coiled tubing assembly includes the downhole logging tool for sensing wellbore and subterranean formations and a coiled tubing pipe to deploy the downhole logging tool into a wellbore. The coiled tubing pipe has a cooling fluid tube to conduct a cooling fluid to the downhole logging tool.

Figure 1:
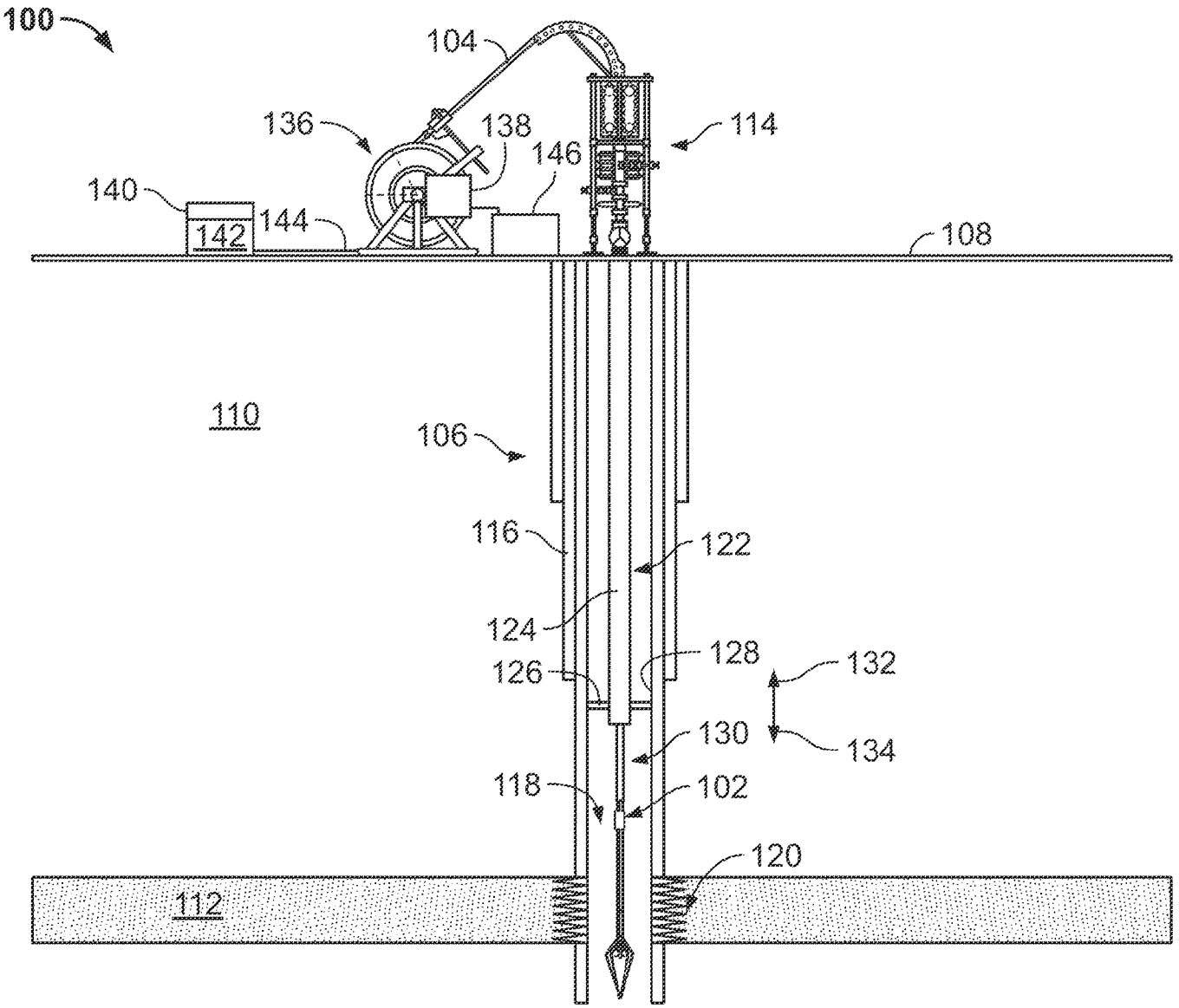
FIG. 1 is a schematic view of a coiled tubing assembly deploying a downhole logging tool into a wellbore.

FIG. 1 is a schematic view of a coiled tubing assembly deploying a logging tool into a wellbore. The coiled tubing assembly 100 includes a coiled tubing pipe 104 and a downhole logging tool 102 coupled to the coiled tubing pipe 104. The coiled tubing pipe 104 has a cooling fluid tube, described in detail in reference to FIGS. 3A-4C, which flows a cooling fluid to the downhole logging tool 102. The downhole logging tool 102 has a high temperature operating limit. Proper operation of the downhole logging tool 102 can be provided for by maintaining a temperature of the downhole logging tool 102 at or below the upper temperature operating limit. In some cases, the high temperature operating limit is 350° F.

A wellbore 106 extends from a surface 108 of the Earth 110. The Earth 110 has subterranean formations 112 which can contain liquid and gaseous phases of various fluids including water, oils, and gases. The wellbore 106 receives the fluids from the subterranean formation 112 and conducts the fluids to the surface 108. The subterranean formation 112 is at a formation temperature and a formation pressure, described in more detail in reference to FIG. 2.

The wellbore 106 has a wellhead assembly 114 positioned on the surface 108 of the Earth 110 to control a flow of fluid to and from the wellbore 106 and allow the coiled tubing assembly 100 to pass into the wellbore 106. The wellbore 106 has a casing 116 defining a borehole 118. The casing 116 can include one or more casing sections such as a conductor, a surface casing, an intermediate casing, and/or a production casing. Some portions of the wellbore 106 can be open hole, that is, there is no casing between the borehole 118 and the subterranean formation 112. The wellbore 106 can include perforations 120 extending through the casing 116 from the borehole 118 through which the water, oils, and gases can flow from the subterranean formation 112 into the borehole 118. The perforations 120 can extend into the subterranean formation 112.

The wellbore 106 can include a completion assembly 122 with a production tubing 124 and a packer 126 positioned in the borehole 118. The packer 126 seals the production tubing 124 to an inner surface 128 of the casing 116. The production tubing 124 is coupled to the wellhead assembly 114 and conducts the water, oils, and hydrocarbon gases from a downhole location 130 in an uphole direction 132 of the packer 126 to the surface 108. The uphole direction 132 is a direction from the subterranean formation 112 toward the surface 108. A downhole direction 134 is a direction opposite the uphole direction 132, that is, from the surface 108 toward the subterranean formation 112.

The coiled tubing assembly 100 includes a coiled tubing reel 136 which the coiled tubing pipe 104 is wrapped about. The coiled tubing reel 136 is positioned proximal to the wellhead assembly 114 to position the downhole logging tool through the wellhead assembly 114 into the wellbore 106. The coiled tubing reel 136 in rotate in a clockwise or counterclockwise direction to increase or decrease a length of the coiled tubing pipe 104 in the wellbore 106. Adjusting the length of the coiled tubing pipe 104 moves the downhole logging tool 102 in the wellbore 106 in the uphole direction 132 or the downhole direction 134. Moving the downhole logging tool 102 in the wellbore 106 in the uphole direction 132 or the downhole direction 134 adjusts the position of the downhole logging tool 102 relative to the location to be logged by the downhole logging tool 102, for example, the subterranean formation 112. Sometimes, other locations or components can be logged with the downhole logging tool 102. For example, the casing 116 can be logged to sense a condition of the casing 116 such as a thickness or a cement quality.

The coiled tubing assembly 100 includes a cooling fluid source 140 containing a volume of a cooling fluid 142. The cooling fluid source 140 is fluidly coupled to the coiled tubing pipe 104 by a fluid conduit 144. The fluid conduit 144 conducts a flow of the cooling fluid 142 to the coiled tubing pipe 104. The cooling fluid source 140 flows the cooling fluid 142 to the coiled tubing pipe 104 through the fluid conduit 144. For example, the cooling fluid source 140) can be pressurized. In some cases, for example, in the open loop arrangement described in detail in reference to FIGS. 3A-3C, a pressure of the cooling fluid source 140 is slightly higher than a borehole fluids pressure so the cooling fluid 142 can be vented out into the borehole 118. In other cases, for example, in the closed loop arrangement described in detail in reference to FIGS. 4A-4C, the pressure of the cooling fluid source 140 is sufficiently high enough to circulate the cooling fluid 142 to the downhole logging tool 102 depending on the downhole logging tool depth in the wellbore 106 and a density of the cooling fluid 142. In other cases, the cooling fluid source 140) can include a pump (not shown) to pressurize the cooling fluid 142 in the cooling fluid source 140 or to flow the cooling fluid 142 from the cooling fluid source 140 into the coiled tubing pipe 104.

In some cases, the cooling fluid source 140 can receive back the cooling fluid 142 from the downhole logging tool 102 after heat has been transferred from the downhole logging tool 102 to the cooling fluid 142. In such cases, the fluid conduit 144 can also conduct the heated cooling fluid 142 from the coiled tubing pipe 104 back to the cooling fluid source 140. In some cases, the cooling fluid source 140 can include a heat exchanger (not shown) to remove heat from the returning heated cooling fluid 142. Such arrangements can be referred to as a closed loop system, described in more detail in reference to FIGS. 4A-4C.

The coiled tubing assembly 100 can include a power source 146 to flow electrical power to the coiled tubing assembly 100. The power source 146 can power one or more of the downhole logging tools 102, components of the cooling fluid source 140, and the coiled tubing reel 136. The power source 146 can generate and/or store electrical power. For example, the power source 146 can be a generator or a battery.

The coiled tubing assembly 100 can include a controller 138 operably coupled to the various components of the coiled tubing assembly 100. The controller 138 can have one or more sets of programmed instructions stored in a memory or other non-transitory computer-readable media that stores data (e.g., connected with the printed circuit board), which can be accessed and processed by a microprocessor. The programmed instructions can include, for example, instructions for sending or receiving signals and commands to operate the downhole logging tool 102, the coiled tubing reel 136, the cooling fluid source 140, and/or the power source 146 and instructions for collecting and storing data from the downhole logging tool 102, the coiled tubing reel 136, the cooling fluid source 140, and/or the power source 146.

Figure 2:
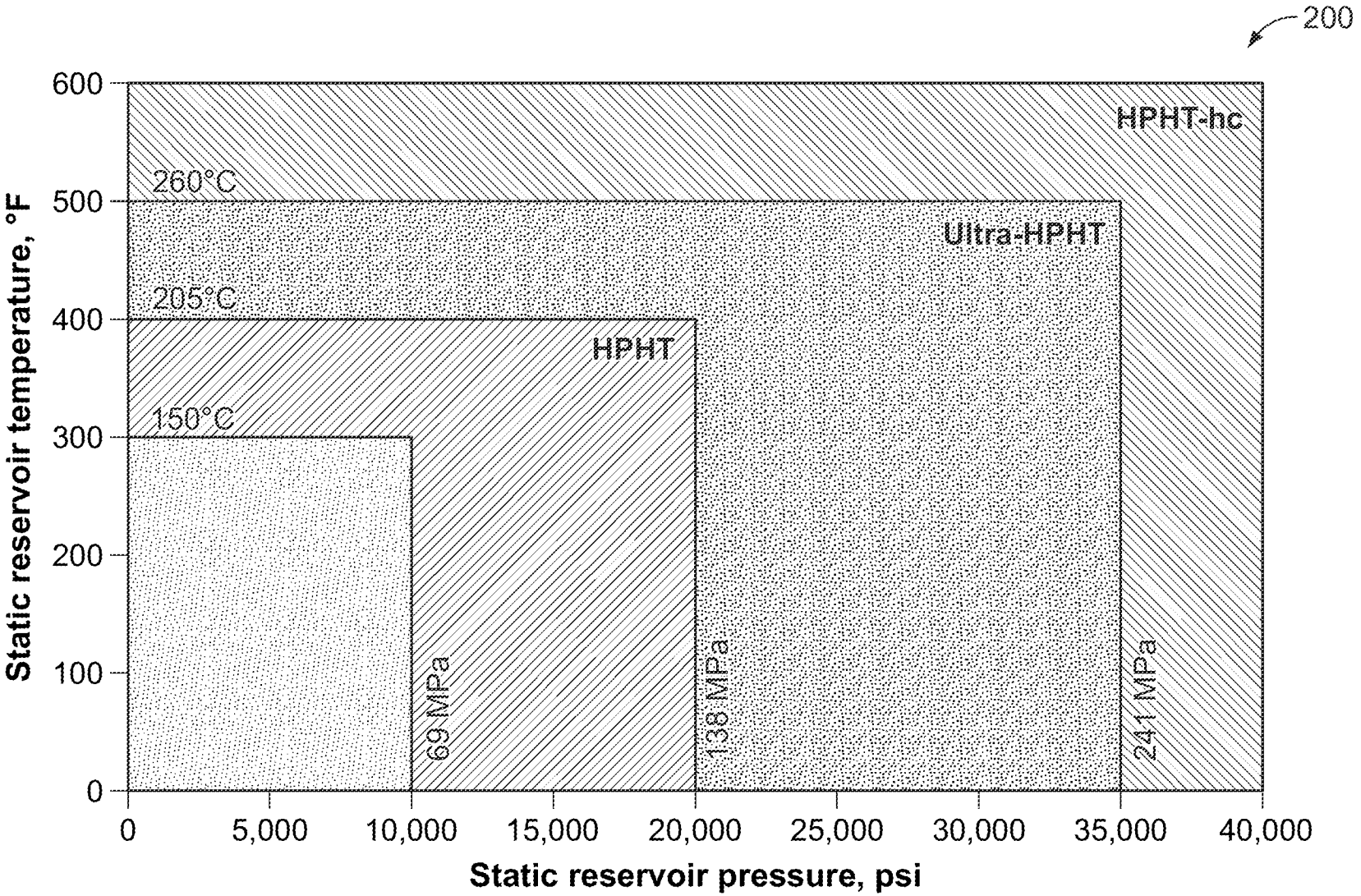
FIG. 2 is a graph of static reservoir pressure versus static reservoir temperature.

FIG. 2 is a graph of static reservoir pressure versus static reservoir temperature. The graph 200 shows the reservoir as a targeted geological formation of the subterranean formations 112 (shown in FIG. 1) which can contain liquid and gaseous phases of various fluids including water, oils, and gases desired to be produced (i.e., conducted to the surface for refinement and use). The fluids (liquids and gases) in the subterranean formation 112 are at a temperature and a pressure. The subterranean formation 112 can be classified based on the values of its temperature and pressure. For example, the subterranean formation 112 can be at classified as a high-temperature when the temperature of the subterranean formation 112 is greater than or equal to 150° C. but less than 205° C., an ultra-high-temperature when the temperature of the subterranean formation 112 is greater than or equal to 205° C. but less than 260° C., or the most extreme environment (high-temperature-hc) when the temperature of the subterranean formation 112 is greater than or equal to 260° C. For example, the subterranean formation 112 can be at classified as a high-pressure when the pressure of the subterranean formation 112 is greater than or equal to 69 MPA but less than 138 MPa, an ultra-high-pressure when the pressure of the subterranean formation 112 is greater than or equal to 138 MPa but less than 241 MPa, or high-pressure-hc when the pressure of the subterranean formation 112 is greater than or equal to 241 MPa. When the downhole logging tool 102 is positioned proximal the subterranean formation 112, heat from the subterranean formation 112 and the fluids contained in the subterranean formation 112 which have flowed into the borehole 118 is transferred to the downhole logging tool 102. The downhole logging tool 102 is also exposed to the subterranean formation 112 pressure. In some cases, a temperature of the downhole logging tool 102 after receiving heat from the subterranean formation 112 and the fluids contained in the subterranean formation 112 can exceed a designed operating temperature upper limit of the downhole logging tool 102. Flowing the cooling fluid through the coiled tubing pipe 104 to and through the downhole logging tool 102 can remove part or all of the heat from the downhole logging tool 102, maintaining the temperature of the downhole logging tool 102 at or below the designed operating temperature upper limit.

Figure 3A:
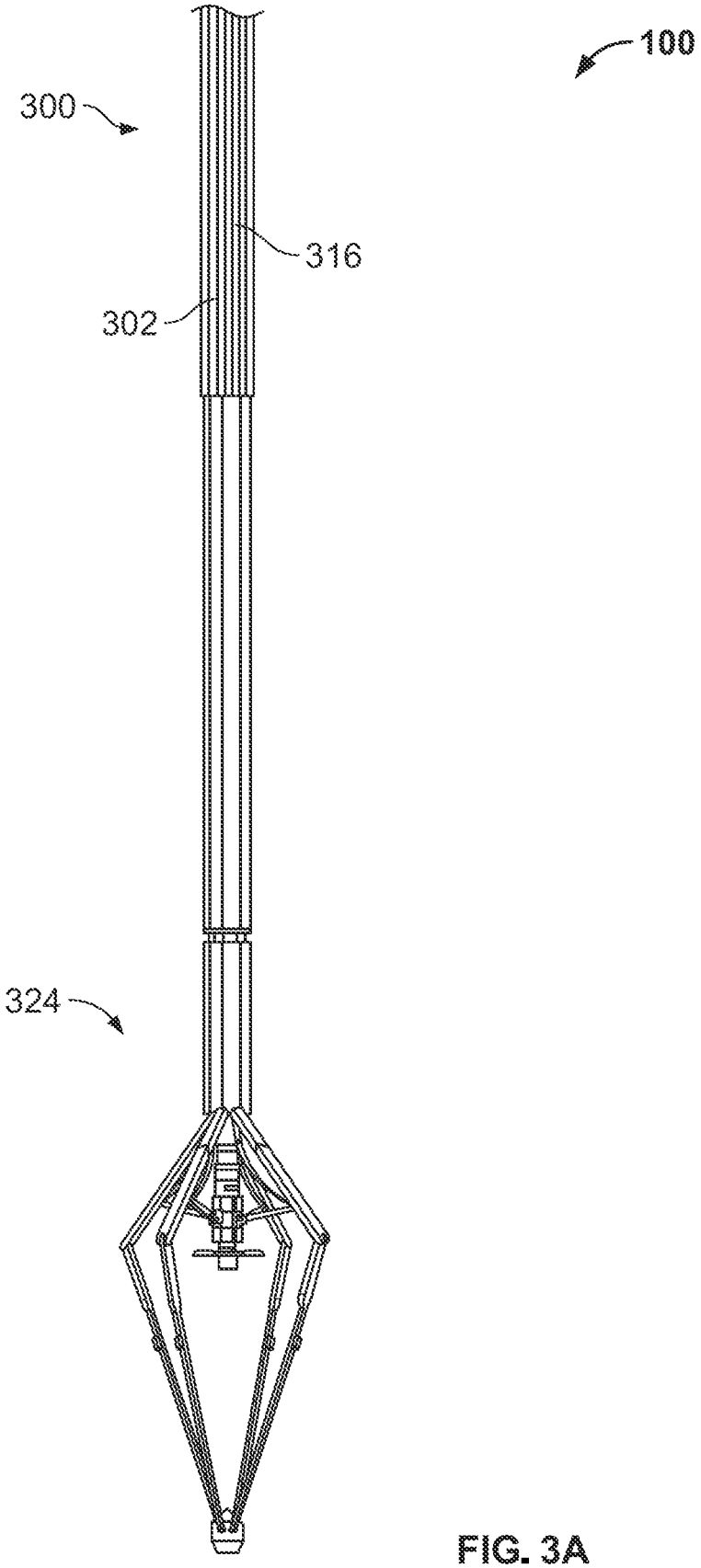
FIG. 3A is a schematic view of a portion of the coiled tubing assembly with the downhole logging tool in an open loop arrangement in the wellbore of FIG. 1.
Figure 3B:
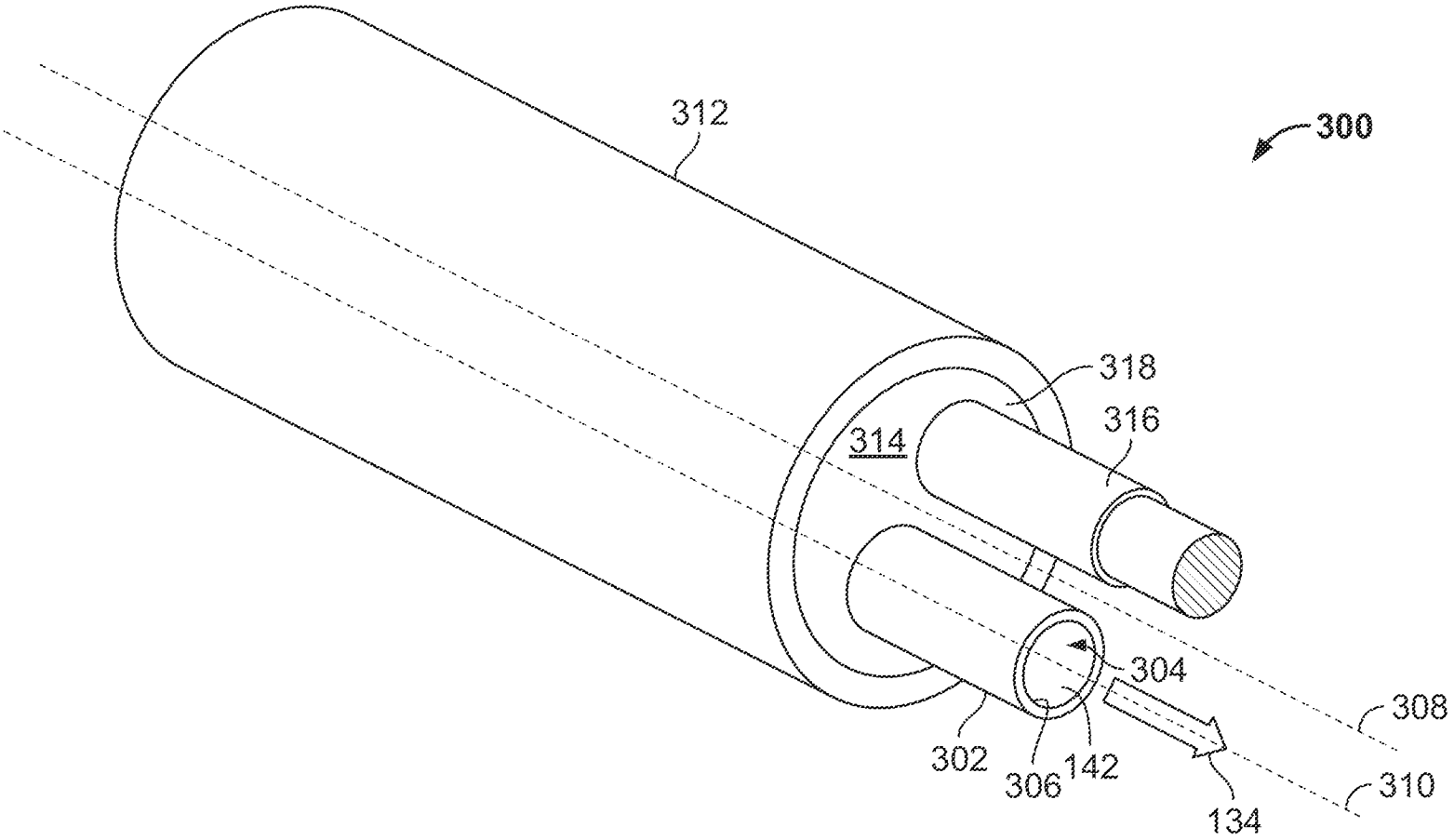
FIG. 3B is a cross-section perspective view of the coiled tubing assembly in the open loop arrangement of FIG. 3A.
Figure 3C:
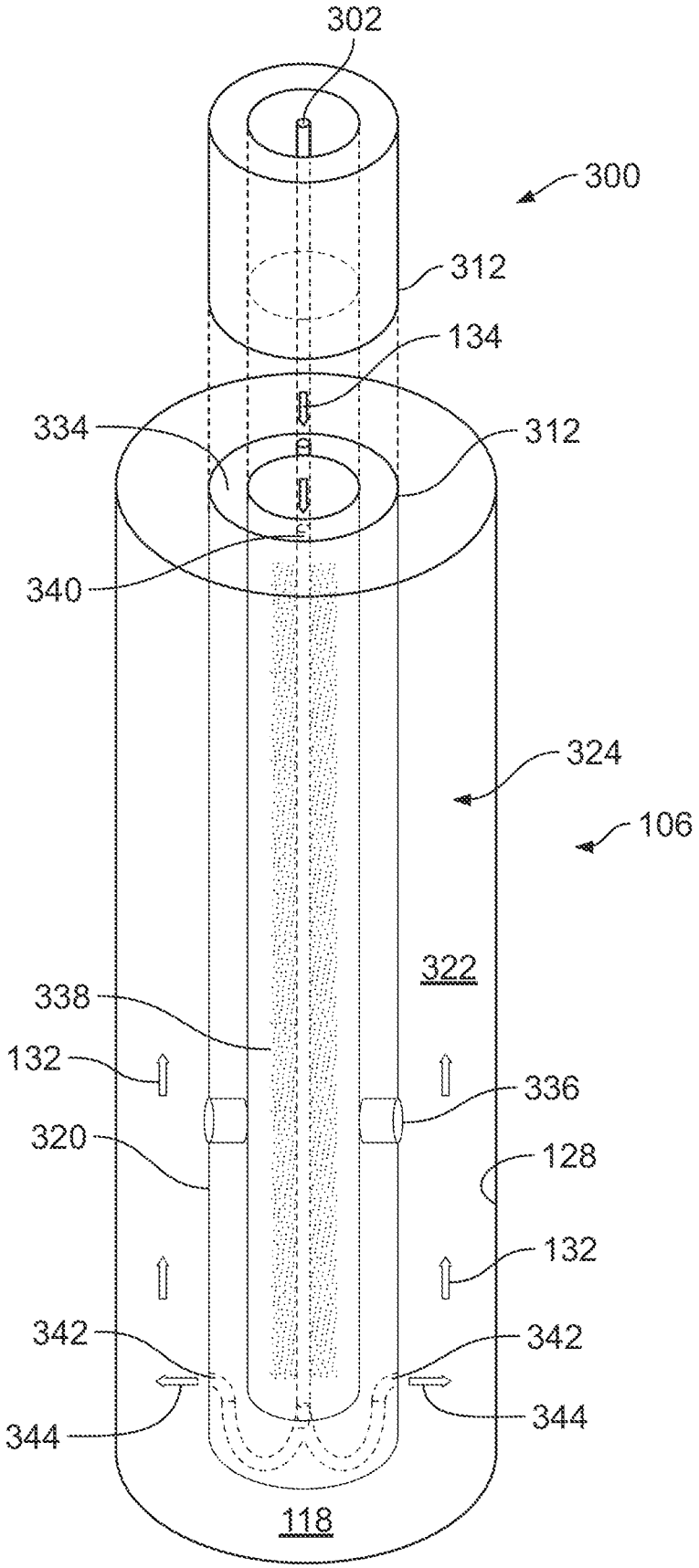
FIG. 3C is a perspective view of the coiled tubing assembly in the open loop arrangement of FIG. 3A.

FIGS. 3A-3C are views of a portion of the coiled tubing assembly with the downhole logging tool in an open loop arrangement in the wellbore of FIG. 1. The coiled tubing assembly 100 includes a downhole logging tool 324 coupled to a coiled tubing pipe 300. The coiled tubing pipe 300 is one embodiment of the coiled tubing pipe 104 described in reference to FIG. 1. The downhole logging tool 324 is one embodiment of the downhole logging tool 324 described in reference to FIG. 1. The coiled tubing pipe 300 includes a cooling fluid tube 302 to flow the cooling fluid 142 to the downhole logging tool 324.

The cooling fluid tube 302 is positioned in and extends through an outer pipe 312 of the coiled tubing pipe 300. The outer pipe 312 can be constructed from a metal. For example, the metal can be a steel or a steel alloy. The outer pipe 312 defines an internal void 314. The cooling fluid tube 302 is positioned within the internal void 314 of the outer pipe 312.

Referring to FIG. 3B, the cooling fluid tube 302 has an internal void 304 defined by an inner surface 306 of the cooling fluid tube 302. The cooling fluid 142 flows through the internal void 304 of the cooling fluid tube 302.

The coiled tubing pipe 300 has a central axis 308. The cooling fluid tube 302 has a central axis 310. In some cases, the central axis 308 of the coiled tubing pipe 300 and the central axis 310 of the cooling fluid tube 302 are parallel. In some cases, the central axis 308 of the coiled tubing pipe 300 and the central axis 310 of the cooling fluid tube 302 are co-linear.

The cooling fluid tube 302 can be constructed from rubber. Some portions of the cooling fluid tube 302 can be constructed from a heat-resistant material. The cooling fluid tube 302 can be constructed from heat-resistant materials to reduce or minimize heat exchange between the cooling fluid 142 and the borehole fluids in an annulus 322 (described in more detail in reference to FIG. 3C) between the inner surface 128 of the casing 116 and downhole logging tool 102. For example, the cooling fluid tube 302 can be a polymer such as polyether ether ketone. Other portions of the cooling fluid tube 302 can be constructed from a heat-transfer material. The cooling fluid tube 302 can be constructed from heat-resistant materials to increase or maximize heat exchange between the cooling fluid 142 and the downhole logging tool 102. For example, the cooling fluid tube 302 can be a metal such as copper.

Referring to FIGS. 1 and 3A-3B, the coiled tubing pipe 300 can include a tool power and communication cable 316. The tool power and communication cable 316 extends from the controller 138 to the downhole logging tool 324 through the outer pipe 312. The tool power and communication cable 316 transmits control signals and status signals to and from the controller 138 and the downhole logging tool 324.

Referring to FIG. 3B, the coiled tubing pipe 300 can include a heat insulating material 318 positioned in the internal void 314 of the outer pipe 312 and surrounding the cooling fluid tube 302 and the tool power and communication cable 316. For example, the heat insulating material 318 can be polystyrene or polyurethane.

Referring to FIG. 3C, the coiled tubing pipe 300 is coupled to the downhole logging tool 324 within the wellbore 106. The downhole logging tool 324 and a portion of the coiled tubing pipe 300 are positioned in the borehole 118. An outer surface 320 of the downhole logging tool 324 and the inner surface 128 of the casing 116 define the annulus 322 in the wellbore 106.

As shown in FIG. 3C, the downhole logging tool 324 includes a connection 334 to couple the downhole logging tool 324 to the coiled tubing pipe 300. For example, the connection 334 can be a tool joint.

The downhole logging tool 324 includes sensors 336 and sensitive electronic boards 338 which are coupled to the controller 138 by the tool power and communication cable 316. The sensors 336 sense conditions of the wellbore 106 and the subterranean formation 112. The sensitive electronic boards 338 operate the downhole logging tool 324 and the sensors 336. The sensitive electronic boards 338 can store, process, and communicate data representing the wellbore 106 and the subterranean formation 112 to the controller 138. The sensitive electronic boards 338 and sensors 336 can generate heat when operating, and the generated heat can be stored in the downhole logging tool 324 in addition to the heat transferred to the downhole logging tool 324 from the subterranean formation 112. One or both the sources of heat can contribute to the temperature of the downhole logging tool 324 reaching or exceeding the high temperature operating upper limit.

The downhole logging tool 324 includes a cooling fluid tube 340 fluidly coupled to the cooling fluid tube 302 to receive the cooling fluid 142 from the cooling fluid tube 302. The cooling fluid tube 340 of the downhole logging tool 324 conducts the cooling fluid 142 past the sensitive electronic boards 338 and the sensors 336 to transfer heat contained in the sensitive electronic boards 338 and the sensors 336 into the cooling fluid 142 in the downhole direction 134.

The downhole logging tool 324 includes cooling fluid vents 342 which pass the heated cooling fluid to outside the downhole logging tool 324 and into the borehole 118. The heated cooling fluid 142 flows through the cooling fluid vents 342 into the annulus 322 in the direction of arrows 344. In the annulus 322, the heated cooling fluid 142 mixes with other wellbore fluids and is conducted to the surface 108 in the uphole direction 132. Such an arrangement can also be referred to as an open loop system.

Figure 4A:
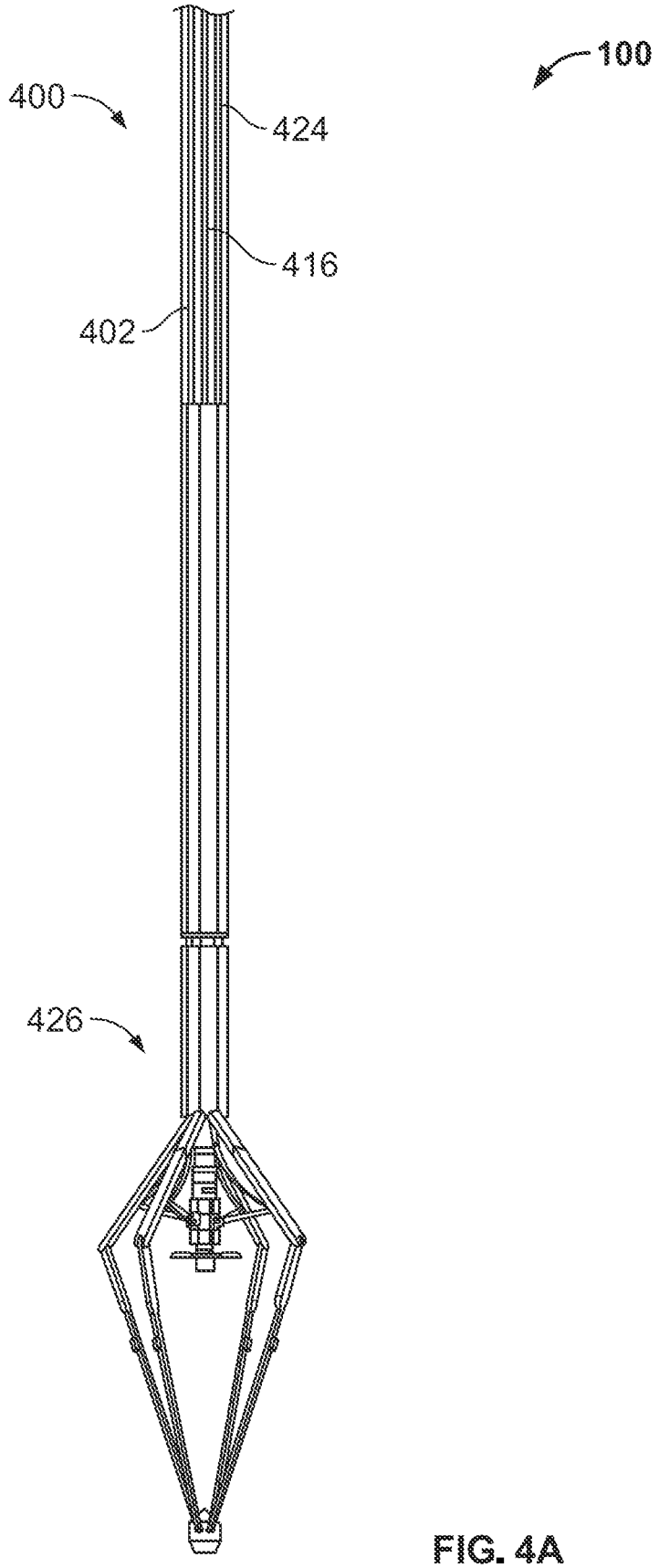
FIG. 4A is a schematic view of a portion of the coiled tubing assembly with the downhole logging tool in a closed loop arrangement in the wellbore of FIG. 1.
Figure 4B:
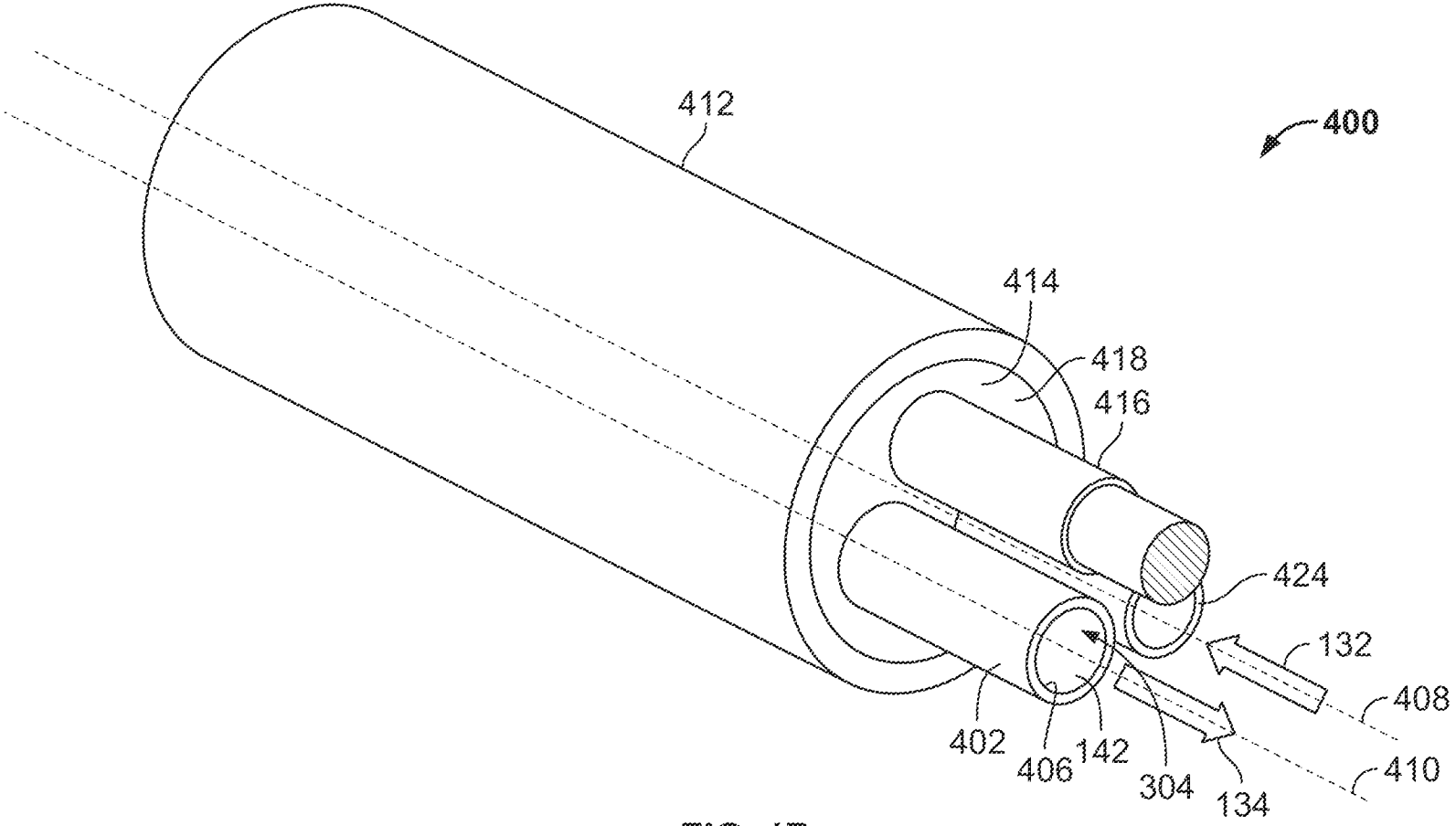
FIG. 4B is a cross-section perspective view of the coiled tubing assembly in the closed loop arrangement of FIG. 4A.
Figure 4C:
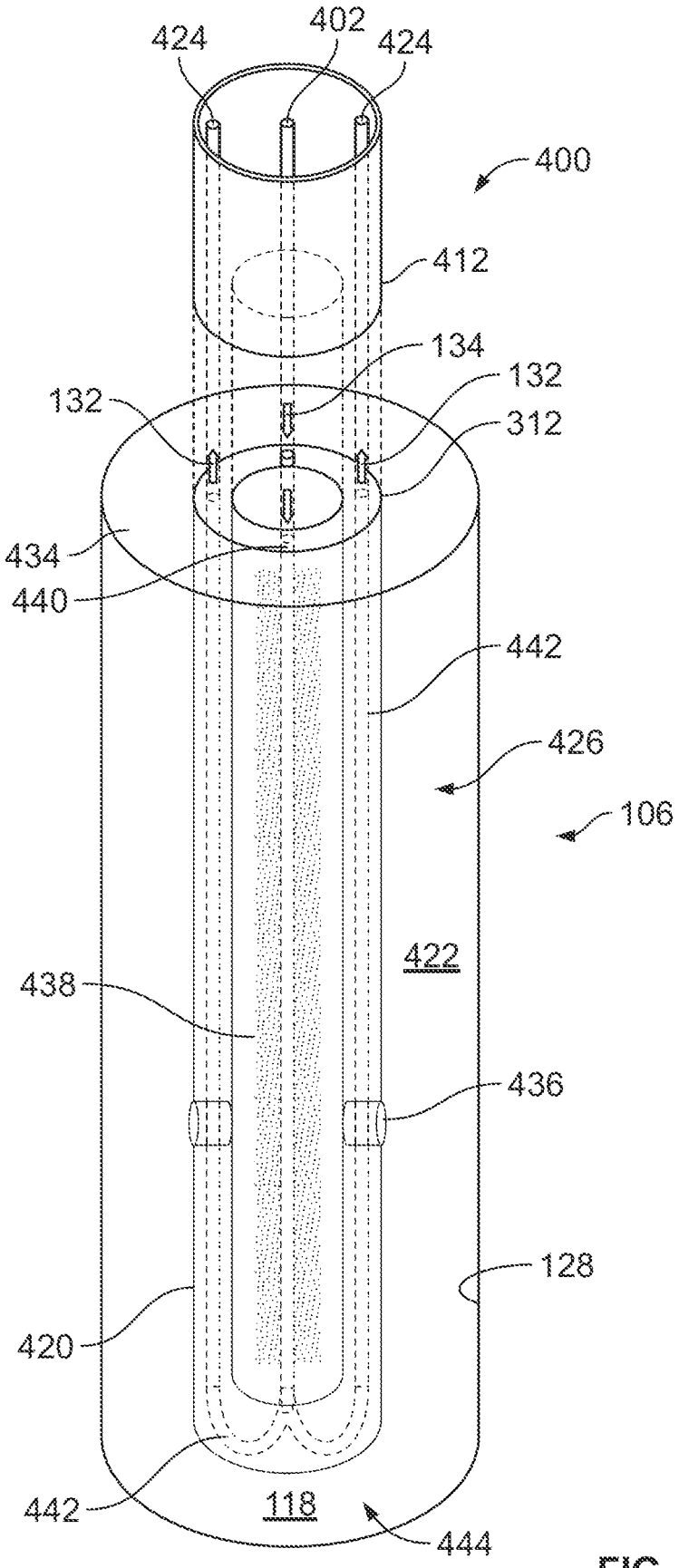
FIG. 4C is a perspective view of the coiled tubing assembly in the closed loop arrangement of FIG. 4A.

FIGS. 4A-4C are views of a portion of the coiled tubing assembly with the downhole logging tool in a closed loop arrangement in the wellbore of FIG. 1. The coiled tubing assembly 100 includes a downhole logging tool 426 coupled to another coiled tubing pipe 400 which are another embodiment of the coiled tubing pipe 104 and the downhole logging tool 426 in the closed loop arrangement. The coiled tubing pipe 400 includes a cooling fluid tube 402 to flow the cooling fluid 142 to the downhole logging tool 426.

The cooling fluid tube 402 is positioned in and extends through an outer pipe 412 of the coiled tubing pipe 400. The outer pipe 412 defines an internal void 414. The cooling fluid tube 402 is positioned within the internal void 414 of the outer pipe 412.

Referring to FIG. 3B, the cooling fluid tube 402 has an internal void 404 defined by an inner surface 406 of the cooling fluid tube 402. The cooling fluid 142 flows through the internal void 404 of the cooling fluid tube 402.

The coiled tubing pipe 400 has a central axis 408. The cooling fluid tube 402 has a central axis 410. In some cases, the central axis 408 of the coiled tubing pipe 400 and the central axis 410 of the cooling fluid tube 402 are parallel. In some cases, the central axis 408 of the coiled tubing pipe 400 and the central axis 410 of the cooling fluid tube 402 are co-linear.

Referring to FIGS. 1 and 4A-4B, the coiled tubing pipe 400 can include a tool power and communication cable 416 substantially similar to the tool power and communication cable 316 previously described. Referring to FIG. 4B, the coiled tubing pipe 400 can include a heat insulating material 418 positioned in the internal void 414 of the outer pipe 412 and surrounding the cooling fluid tube 402 and the tool power and communication cable 416 substantially similar to the heat insulating material 418 previously described in reference to FIG. 3B.

Referring to FIGS. 4A-4C, the coiled tubing pipe 400 includes a heat exchanged fluid tube 424. The heat exchanged fluid tube 424 is positioned in and extends through the coiled tubing pipe 400 and is coupled to the cooling fluid source 140 and the downhole logging tool 426. The heat exchanged fluid tube 424 receives the heated cooling fluid 142 from the downhole logging tool 426 and conducts the heated cooling fluid 142 to the cooling fluid source 140, where the heated cooling fluid 142 can be cooled for reuse in cooling the downhole logging tool 426.

The heat exchanged fluid tube 424 can be constructed from rubber. In some cases, the heat exchanged fluid tube 424 can be constructed from a heat-resistant material. For example, the heat exchanged fluid tube 424 can be constructed from a polymer such as polyether ether ketone.

Referring to FIG. 4C, the coiled tubing pipe 400 is coupled to the downhole logging tool 102 within the wellbore 106. The downhole logging tool 426 and a portion of the coiled tubing pipe 400 are positioned in the borehole 118. An outer surface 420 of the downhole logging tool 426 and the inner surface 128 of the casing 116 define an annulus 422 in the wellbore 106.

As shown in FIG. 4C, the downhole logging tool 426 includes a connection 434 to couple the downhole logging tool 426 to the coiled tubing pipe 400. For example, the connection 434 can be a tool joint.

The downhole logging tool 426 includes sensors 436 and sensitive electronic boards 438 which are coupled to the controller 138 by the tool power and communication cable 416. The sensors 436 sense conditions of the wellbore 106 and the subterranean formation 112. The sensitive electronic boards 438 operate the downhole logging tool 426 and the sensors 436. The sensitive electronic boards 438 can store, process, and communicate data representing the wellbore 106 and the subterranean formation 112 to the controller 138.

The downhole logging tool 426 includes a cooling fluid tube 440 fluidly coupled to the cooling fluid tube 402 to receive the cooling fluid 142 from the cooling fluid tube 402. The cooling fluid tube 440 of the downhole logging tool 426 conducts the cooling fluid 142 past the sensitive electronic boards 438 and the sensors 436 to transfer heat contained in the sensitive electronic boards 438 and the sensors 436 into the cooling fluid 142 in the downhole direction 134.

The downhole logging tool 426 includes heat exchanged fluid tubes 442 coupled to a downhole end 444 of the downhole logging tool 426 cooling fluid tube 440 and the heat exchanged fluid tube 424 to pass the heated cooling fluid 142 to the heat exchanged fluid tube 424 and back to the cooling fluid source 140 in the uphole direction through the coiled tubing pipe 400. The heated cooling fluid 142 flows through the heat exchanged fluid tube 424 in the direction of arrows 132. Such an arrangement can also be referred to as the closed loop system.

The cooling fluid tubes 302, 402 of the coiled tubing pipes 300, 400 are shown as a single tube. However, some embodiments can include multiple cooling fluid tubes 302 in the coiled tubing pipes 300, 400 to conduct the cooling fluid 142 to the downhole logging tools 324, 426, respectively.

The cooling fluid tubes 340, 440 of the downhole logging tools 324, 426 are shown as a single tube. However, some embodiments can include multiple cooling fluid tubes 340, 440 to conduct the cooling fluid 142 to separate parts or different locations on the sensitive electronic boards 338, 438 and the sensors 336, 436 of the downhole logging tools 324, 426, respectively. In yet other implementations, the cooling fluid tubes 340, 440 of the downhole logging tools 324, 426 can branch or combine and various locations in the downhole logging tools 324, 426.

In some embodiments, downhole logging tools 324, 426 can include various components to control the flow of the cooling fluid 142 to or past the sensitive electronic boards 338, 438 and the sensors 336, 436. For example, the downhole logging tools 324, 426 can include valves (not shown) to open, close, or throttle open, or throttle close to stop or adjust the flow the cooling fluid 142. For example, the cooling fluid tubes 340, 440 can include downhole logging tools 324, 426 flow restrictors (not shown). In other words, some portions of the cooling fluid tubes 340, 440 have smaller or larger inner diameters to flow the cooling fluid 142 to or past the sensitive electronic boards 338, 438 and the sensors 336, 436.

Figure 5:
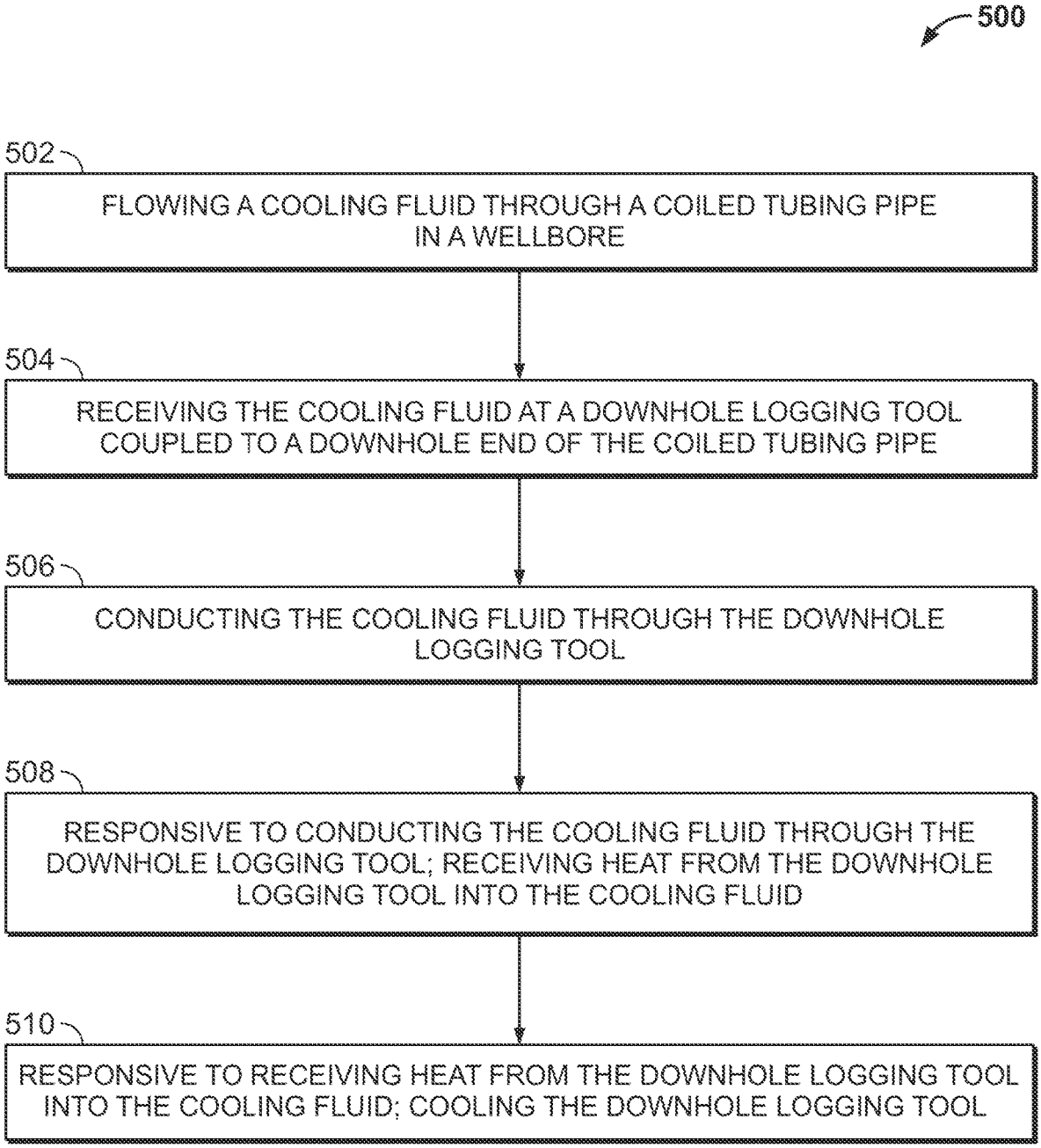
FIG. 5 is a flow chart of an example method of cooling wellbore tools.

FIG. 5 is a flow chart of an example method 500 of cooling a logging tool according to the implementations of present disclosure. At 502, a cooling fluid is flowed through a coiled tubing pipe in a wellbore. Referring to FIGS. 3A-4C, for example, the cooling fluid 142 can be conducted through the cooling fluid tubes 302, 402 positioned in the wellbore 106.

In some implementations, before flowing the cooling fluid through the coiled tubing pipe, the downhole logging tool is positioned in the wellbore by the coiled tubing pipe. Referring to FIGS. 1 and 3A-4C, for example, the coiled tubing reel 136 can rotate to extend or decrease a length of the coiled tubing pipe 104 in the wellbore 106 which raises or lowers the downhole logging tool 102 in an uphole direction 132 or a downhole direction 134.

In some implementations, the downhole logging tool is positioned in the wellbore proximal a formation having a formation temperature greater than 300° F. Referring to FIGS. 1 and 2, the subterranean formation 112 can be a high temperature high pressure formation.

In some implementations, flowing the cooling fluid through the coiled tubing pipe includes suppling the cooling fluid from a cooling fluid source positioned on a surface of the Earth into a cooling fluid tube positioned in the coiled tubing pipe. For example, referring to FIGS. 1 and 3A-4C, the cooling fluid source 140 at the surface 108 flows the cooling fluid 142 into the cooling fluid tubes 302, 402 positioned in the coiled tubing pipes 300, 400, respectively.

In some implementations, a portion of the cooling fluid tube is insulated to reduce a transfer of heat to the cooling fluid. Referring to FIG. 3B, the cooling fluid tube 300 includes the heat insulating material 318 positioned in the internal void 314 of the outer pipe 312. For example, referring to FIG. 4B, the cooling fluid tube 400 includes the heat insulating material 418 positioned in the internal void 414 of the outer pipe 412.

In some implementations, the downhole logging tool includes at least one sensor or electrical circuit having a high temperature operating upper limit. A flow of the cooling fluid past the downhole logging tool maintains a temperature of the sensor or the electrical circuit below the high temperature operating upper limit. In some cases, the high temperature operating upper limit of the downhole logging tool is 350° F. The flow of the cooling fluid past the downhole logging tool conducts heat from the downhole logging tool to the cooling fluid. For example, referring to FIGS. 3C and 4C, each of the downhole logging tools 324, 426 have sensitive electronic boards 338, 438 and sensors 336, 436 with high temperature operating upper limits. The cooling fluid 142 flowing past the sensitive electronic boards 338, 438 and sensors 336, 436 can maintain the temperature of the sensitive electronic boards 338, 438 and sensors 336, 436 at or below the high temperature operating upper limit of the respective component.

At 504, the cooling fluid is received at a downhole logging tool coupled to a downhole end of the coiled tubing pipe. Referring to FIGS. 1 and 3A-4C, for example, the cooling fluid 142 can be received at the downhole logging tool 102 at the downhole end 130 of the coiled tubing assembly 100.

At 506, the cooling fluid is conducted through the downhole logging tool. Referring to FIGS. 1 and 3A-4C, for example, the cooling fluid 142 flows from the cooling fluid tubes 302, 402 of the coiled tubing pipe 104 to the cooling fluid tubes 340, 440 of the downhole logging tools 324, 426 and pass through the downhole logging tools 324, 426.

At 508, responsive to conducting the cooling fluid through the downhole logging tool; heat is received from the downhole logging tool into the cooling fluid. Referring to FIGS. 1 and 3A-4C, for example, as the cooling fluid 142 flows through the cooling fluid tubes 340, 440 of the downhole logging tools 324, 426 heat is received from the downhole logging tools 324, 426 into the cooling fluid 142.

At 510, responsive to receiving heat from the downhole logging tool into the cooling fluid: the downhole logging tool is cooled. Referring to FIGS. 1 and 3A-4C, for example, the reduction in stored heat from the downhole logging tools 324, 426 cools the downhole logging tools 324, 426.

In some implementations, the downhole logging tool can be operated. In some cases, operating the downhole logging tool includes: transmitting electrical power from a controller having a power source to the downhole logging tool by a tool power and communication cable positioned in the coiled tubing pipe where the controller is positioned on a surface of the Earth; transmitting control signals from the controller to the downhole logging tool by the tool power and communication cable; and receiving status signals and formation data at the controller from the downhole logging tool by the tool power and communication cable. For example, referring to FIGS. 3B and 4B, the tool power and communication cable 316, 416 extends from the controller 138 to the downhole logging tool 324, 426. The tool power and communication cable 316, 416 extends through the outer pipe 312, 412. The tool power and communication cables 316, 416 transmit control signals and status signals to and from the controller 138 and the downhole logging tools 324, 426.

In some implementations, after receiving heat from the downhole logging tool into the cooling fluid, the heated cooling fluid flows through a cooling fluid vent extending through the downhole logging tool to an annulus defined by an inner surface of the wellbore and an outer surface of the downhole logging tool. Referring to FIG. 3C, in the open loop arrangement, the cooling fluid vents 342 pass the heated cooling fluid to outside the downhole logging tool 324 and into the borehole 118 in the direction of arrows 344. In the annulus 322, the heated cooling fluid 142 is conducted to the surface 108 in the uphole direction 132 through the annulus 322.

In some implementations, after receiving heat from the downhole logging tool into the cooling fluid, the heated cooling fluid flows through a heat exchanged fluid tube of the coiled tubing pipe in an uphole direction through the coiled tubing pipe. In some cases, flowing the heated cooling fluid through a heat exchanged fluid tube of the coiled tubing pipe in an uphole direction through the coiled tubing pipe includes conducting the cooling fluid to a surface of the Earth in the uphole direction. Referring to FIG. 3C, for example, in the closed loop arrangement, the coiled tubing pipe 400 conducts the flow the cooling fluid 142 through the cooling fluid tube 402 to the downhole logging tool 426. The heated cooling fluid 142 flow to the heat exchanged fluid tubes 442 and then to the heat exchanged fluid tube 424 to pass the heated cooling fluid 142 back to the cooling fluid source 140 in the uphole direction through the coiled tubing pipe 400 in the direction of arrows 132.

While the disclosure includes a limited number of embodiments, those skilled in the art, having benefit of this disclosure, will appreciate that other embodiments can be devised which do not depart from the scope of the present disclosure. Accordingly, the scope should be limited only by the attached claims.

The invention claimed is:

1. A coiled tubing assembly comprising:

a downhole logging tool; and a coiled tubing pipe coupled to the downhole logging tool, the coiled tubing pipe configured to position the downhole logging tool in a wellbore, the coiled tubing pipe comprising:

a cooling fluid tube positioned within the coiled tubing pipe, the cooling fluid tube defining an internal void; and a cooling fluid vent extending from the internal void of the coiled tubing pipe to an outer shell of the downhole logging tool, the downhole logging tool coupled to a downhole end of the cooling fluid tube, the cooling fluid tube configured to conduct a cooling fluid to past the downhole logging tool and exclusively out of the downhole logging tool into a wellbore annulus between the wellbore and the downhole logging tool.

2. The coiled tubing assembly of claim 1, wherein the coiled tubing pipe further comprises a first end coupled to a coiled tubing reel and a second end coupled to the downhole logging tool, the coiled tubing assembly further comprising a cooling fluid source coupled to the first end of the coiled tubing pipe, the cooling fluid source configured to supply the cooling fluid to the cooling fluid tube.

3. The coiled tubing assembly of claim 1, wherein the downhole logging tool comprises at least one of a sensor or an electrical circuit having a high temperature operating upper limit.

4. The coiled tubing assembly of claim 3, wherein the high temperature operating upper limit of the downhole logging tool is 350° F. or higher.

5. The coiled tubing assembly of claim 3, wherein a flow of the cooling fluid through the cooling fluid tube past the downhole logging tool conducts heat from the downhole logging tool to the cooling fluid.

6. The coiled tubing assembly of claim 3, wherein a flow of the cooling fluid through the cooling fluid tube past the downhole logging tool maintains a temperature of the sensor or the electrical circuit below the respective high temperature operating upper limit.

7. The coiled tubing assembly of claim 1, wherein the coiled tubing pipe further comprises a tool power and communication cable extending from a controller to the downhole logging tool and positioned in and extending through the coiled tubing pipe, the controller configured to perform operations comprising operating the coiled tubing assembly and the downhole logging tool.

8. The coiled tubing assembly of claim 1, wherein the cooling fluid vent conducts the cooling fluid from the downhole logging tool to the wellbore annulus.

9. The coiled tubing assembly of claim 1, wherein the coiled tubing pipe further comprises a heat exchanged fluid tube positioned in and extending through the coiled tubing pipe, the heat exchanged fluid tube coupled to a downhole end of the cooling fluid tube, the heat exchanged fluid tube configured to receive the cooling fluid from the cooling fluid tube and conduct the cooling fluid in an uphole direction through the coiled tubing pipe.

10. The coiled tubing assembly of claim 9, wherein the heat exchanged fluid tube conducts the cooling fluid to a surface of the Earth in the uphole direction.

* * * * *